US010196593B2

(12) United States Patent
Zerhusen et al.

(10) Patent No.: US 10,196,593 B2
(45) Date of Patent: Feb. 5, 2019

(54) LAUNDRY TREATMENT PARTICLES INCLUDING SILICONE

(71) Applicant: The Procter & Gamble Company, Cincinnati, OH (US)

(72) Inventors: Jaden Scott Zerhusen, Florence, KY (US); Matthew Lawrence Lynch, Mariemont, OH (US); Philip Andrew Sawin, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 15/171,764

(22) Filed: Jun. 2, 2016

(65) Prior Publication Data

US 2017/0349865 A1 Dec. 7, 2017

(51) Int. Cl.

| | |
|---|---|
| ***C11D 17/06*** | (2006.01) |
| ***C11D 17/00*** | (2006.01) |
| ***C11D 17/04*** | (2006.01) |
| ***C11D 3/50*** | (2006.01) |
| ***C11D 3/37*** | (2006.01) |
| ***C11D 3/00*** | (2006.01) |

(52) U.S. Cl.

CPC ..... *C11D 17/06* (2013.01); *C11D 3/001* (2013.01); *C11D 3/373* (2013.01); *C11D 3/50* (2013.01); *C11D 3/505* (2013.01); *C11D 17/041* (2013.01)

(58) Field of Classification Search

CPC ..... C11D 17/06; C11D 17/00; C11D 17/041; C11D 3/001; C11D 3/50; C11D 3/505; C11D 3/373; C11D 3/3734; C11D 3/3738; C11D 3/3742

USPC ..... 510/445, 101, 400, 349, 439

See application file for complete search history.

(56) References Cited

U.S. PATENT DOCUMENTS

| | | | | |
|---|---|---|---|---|
| 4,209,417 | A | 6/1980 | Whyte | |
| 4,652,392 | A | 3/1987 | Baginski et al. | |
| 5,154,849 | A | 10/1992 | Visscher et al. | |
| 5,759,208 | A | 6/1998 | Zhen et al. | |
| 5,770,556 | A | 6/1998 | Farrell et al. | |
| 5,783,536 | A | 7/1998 | Farrell et al. | |
| 5,935,917 | A | 8/1999 | Farrell et al. | |
| 6,174,843 | B1 | 1/2001 | Peyton et al. | |
| 6,673,766 | B1 | 1/2004 | Hartshorn et al. | |
| 9,150,819 | B2 | 10/2015 | Wetrosky et al. | |
| 2012/0270765 | A1* | 10/2012 | Aouad | C11D 3/3707 512/4 |
| 2014/0179587 | A1* | 6/2014 | Brown | C11D 3/3707 510/349 |
| 2015/0018264 | A1 | 1/2015 | Somerville Roberts et al. | |
| 2016/0145539 | A1 | 5/2016 | Blattner et al. | |
| 2016/0177241 | A1 | 6/2016 | Brundel et al. | |
| 2016/0298058 | A1 | 10/2016 | Christensen et al. | |
| 2016/0304808 | A1* | 10/2016 | Lynch | C11D 17/06 |
| 2016/0304809 | A1* | 10/2016 | Lynch | A61Q 5/02 |
| 2016/0304810 | A1* | 10/2016 | Lynch | C11D 17/06 |
| 2016/0304811 | A1* | 10/2016 | Lynch | A61Q 5/12 |
| 2016/0304812 | A1* | 10/2016 | Lynch | C11D 17/06 |
| 2016/0304819 | A1* | 10/2016 | Lynch | C11D 3/001 |

FOREIGN PATENT DOCUMENTS

| | | | |
|---|---|---|---|
| EP | 1749877 | A1 | 2/2007 |
| WO | WO 2008/009521 | A1 * | 1/2008 |
| WO | WO2008009521 | A1 | 1/2008 |
| WO | WO2009071373 | A1 | 6/2009 |
| WO | WO2012048955 | A1 | 4/2012 |
| WO | WO 2016078941 | A1 * | 5/2016 |
| WO | WO 2017105853 | A1 * | 6/2017 |

OTHER PUBLICATIONS

International Search Report for International Application No. PCT/US2017/035389, dated Aug. 17, 2017, 26 pages.

* cited by examiner

*Primary Examiner* — Lorna M Douyon
(74) *Attorney, Agent, or Firm* — Gary J. Foose

(57) ABSTRACT

A composition including: a plurality of first particles including: (i) about 30% to about 95% by weight of the first particles a water soluble first carrier, wherein the first particles have a first particles onset of melt from about 25° C. to about 120° C.; and perfume; and (ii) a plurality of second particles including: about 30% to about 95% by weight of the second particles a water soluble second carrier, wherein the second particles have a second particles onset of melt from about 25° C. to about 120° C.; and silicone; wherein the first particles and the second particles are in a package.

19 Claims, 1 Drawing Sheet

LAUNDRY TREATMENT PARTICLES INCLUDING SILICONE

FIELD OF THE INVENTION

Particulate laundry additive including silicone.

BACKGROUND OF THE INVENTION

Consumers of laundry detergents enjoy having the ability to customize the technologies they use in caring for their clothes and household fabrics. This is evidenced by the vast number of choices of cycles and variations to choose from in modern washing machines, the variety of pretreatment and wash additives available in the market, and the variety of laundry treatment compositions to choose from in the market.

Many consumers have a particular affinity for wearing garments that have a soft feel and pleasant scent. Liquid fabric enhancers are commonly employed by consumers to obtain garments having a soft feel and pleasant scent. Since many fabric conditioning agents are hydrophobic, it can be difficult to provide aqueous liquid products that include such hydrophobic fabric conditioning agents. Further, many perfume raw materials have a hydrophobe in their molecular structure. Thus, products that combine hydrophobic fabric conditioning agents and perfume raw materials having a hydrophobe in their molecular structure can be difficult to provide to consumers.

Furthermore, some consumers do not integrate liquid fabric enhancers into their routine for doing laundry because an extra step that requires care is required. The consumer must carefully pour the liquid fabric enhancer into the fabric softener dispenser of the washing machine. Many consumers would prefer a more carefree approach to achieving the benefit of additional softness and enhanced scent.

With these limitations in mind, there is a continuing unaddressed need for a product that combines hydrophobic fabric conditioning agents and perfume that is convenient to use.

SUMMARY OF THE INVENTION

A composition comprising: a plurality of first particles comprising: (i) about 30% to about 98% by weight of said first particles a water soluble first carrier, wherein said first particles have a first particles onset of melt from about 25° C. to about 120° C.; and perfume carried by said first carrier; and (ii) a plurality of second particles comprising: about 30% to about 98% by weight of said second particles a water soluble second carrier, wherein said second particles have a second particles onset of melt from about 25° C. to about 120° C.; and silicone carried by said second carrier; wherein said first particles and said second particles are in a package.

A process for laundering articles of fabric with the composition of the preceding paragraph comprising the steps of: dispensing said composition according to the preceding paragraph into a washing machine dispensing into said washing machine a detergent composition comprising a surfactant, wherein said composition and said detergent composition are from different packages; placing one or more articles of fabric into said washing machine; and washing said fabric with said composition and said detergent composition.

DETAILED DESCRIPTION OF THE INVENTION

Figure 1:
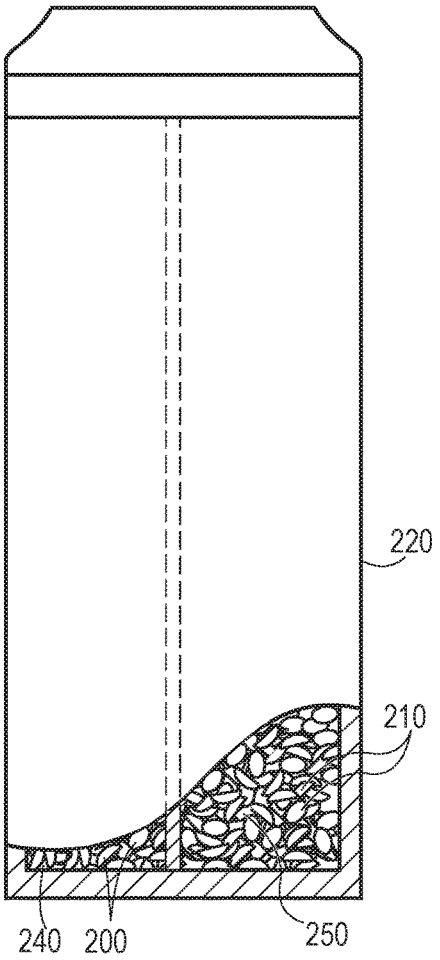
FIG. 1 is a package containing first particles and second particles, the first particles are in a first chamber of the package and the second particles are in a second chamber of the package.

Particulate laundry additives are known to be attractive to consumers as evidenced by products such as DOWNY UNSTOPABLES, which is a product that is widely used by consumers. To date, commercially successful particulate laundry additives have been confined to stain treatment compositions, such as or including bleach, and laundry scent additives. One of the attributes of such products is that the consumer enjoys the experience of dosing such products to the wash and having the feeling of being able to customize the results obtained from laundering clothing. The consumer can add a lot or a little of the laundry additive, depending on how the consumer perceives the need and the level of benefit that is desirable.

Since there are many tasks to be accomplished in laundering clothes such as, cleaning, stain removal, brightness, fabric restoration, softness, scent, static control, and the like, one could in theory provide a separate product for each task to be done and the consumer could completely customize the kind and amount of each benefit agent that is applied in the wash. This could become overly complicated for the consumer and require the consumer to dispense and store multiple products in his or her laundering area and combine in the optimal quantities. There are thought to be particular combinations of tasks and benefits to be obtained that the consumer might like to have available in a single product for which the dose can be customized by the consumer.

One combination of benefits that consumers are thought to be particularly desirable of is softness and scent. Silicone is a softening agent that can deliver a particularly pleasing consumer benefit. Hence, formulating products that include silicone is desirable.

One approach to formulating such a particulate product might be to provide silicone and perfume together in a water soluble carrier. The consumer could then dispense the particles to the wash at the beginning of the wash cycle, during washing and/or rinsing allowing the water soluble carrier to disperse into water to release the silicone and perfume, and the silicone and perfume could be deposited on the clothing. Unfortunately, formulating such a product can prove to be difficult.

Many water soluble carrier materials are hydrophilic. Hydrophilic water soluble carriers are desirable since they can be rapidly wetted and dispersed in water. Inconveniently, many perfume raw materials have a hydrophobic portion and hydrophilic portion. When silicone and perfume are mixed with a melt of water soluble carrier, it is thought, without being bound by theory, that possibly the hydrophilic portion of the perfume raw material is oriented towards the hydrophilic water soluble carrier and the hydrophobic portion of the perfume raw material is oriented towards the silicone. The interaction between the hydrophobe of the perfume raw material can drive down the size of the droplets of silicone in the particles comprising water soluble carrier, perfume, and silicone. Once the particles are dissolved in water during washing, the small droplets of silicone may not deposit on fabrics as efficiently as larger droplets. Hence, much of the silicone, in the form of small droplets, may not be deposited on the fabric and may be washed away with the rinse water.

To overcome the difficulties of formulating a particulate product that contains both silicone and perfume that when dissolved in the wash can provide for large enough droplets of silicone, it can be convenient to provide the silicone and the perfume in separate particles in a composition.

The composition can comprise a plurality of first particles and a plurality of second particles. The first particles can comprise perfume and the second particles can comprise silicone. The first particles and second particles can be in a package. Providing the perfume and silicone in separate particles overcomes the aforesaid problems associated with trying to provide silicone and perfume in a single particle. The package can be a package selected from the group consisting of a carton, bottle, water soluble pouch, and water pervious pouch. The package can have a single chamber or a plurality of chambers. The package may have two chambers.

Since the composition comprises both first particles and second particles, combinations of the two pluralities of particles into a single composition can advantageously be provided with first particles and second particles that have a first particles onset of melt and second particles onset of melt that is from about 25° C. to about 120° C. First particles and second particles having an onset of melt within such a range can provide for formula stability from production to use, especially if the first particles and second particles are packaged together in a single chamber of a package.

Onset of melt of the particles can provide insight into the ability of the composition to be stable during shipment, during which the composition might be subjected to elevated temperatures. For instance, if the composition is expected to be exposed to temperatures in excess of 35° C., it can be practical to have the first particles onset of melt and second particles onset of melt between about 35° C. and about 120° C. Otherwise, there is the possibility that the particles forming the composition melt and stick together, clump, or otherwise become physically combined with one another after production. Particles that are stuck together end up having a larger mass and may be difficult to precisely dose to the wash and the masses of particles may not disperse into the wash water during the washing cycle.

The first particles can comprise about 30% to about 98% by weight of the first particles a water soluble first carrier. Such weight fraction of carrier can be practical in that it leaves enough formulation space in the first particles that benefit agents can provided in the first particles. The first particles can comprise perfume. The first particles can comprise encapsulated benefit agents, including encapsulated perfume.

The second particles can comprise about 30% to about 98% by weight of the second particles a water soluble second carrier. Such a weight fraction can be practical for providing formulation space for silicone, and optionally other benefit agents.

Optionally, the first carrier and the second carrier can be different materials. By using different carrier materials, the dissolution properties of the first particles and the second particles can be controlled or set or selected independently. For instance, it may be beneficial to have the first particles comprising perfume dissolve before the second particles comprising silicone. Early dissolving perfumed first particles may provide room bloom of the perfume when the consumer fills the washing tub of a top load washing machine. Delaying release of the silicone from the second particles may improve deposition of the silicone on the fabrics in the wash depending on the wash cycle.

To simplify manufacturing of the first particles, the first carrier and the perfume can be mixed with one another. Manufacturing is simplified in that the operator can provide a mixture of the water soluble carrier and perfume and form the particles from the mixture. The first carrier and perfume can be mixed with one another or even homogeneously mixed with one another. Having the perfume dispersed in the first carrier as a mixture can help to promote controlled release of the perfume as the first particles dissolve. Release of the perfume can be designed for by employing a particular carrier that is understood to disperse in the wash at a certain rate at a particular temperature of the wash liquor.

Similar to the first carrier and perfume, the second carrier and the silicone can be mixed with one another. Such an arrangement might provide a benefit of relatively slow release of silicone which might promote better deposition onto fabrics. The silicone can be dispersed in the second carrier, and thereby second particles, as droplets.

The composition can comprise from about 10% to about 90% by weight the first particles and from about 10% to about 90% by weight the second particles. The first particles and the second particles can be packaged together. Packaged together, first particles and second particles in the aforesaid ranges can provide both a scent benefit and a softness benefit to fabrics when washed in a solution in which such particles are dissolved. The levels of the two fractions of particles can be set to provide the desired balance of scent benefit and softness benefit in the final composition when used. The composition can comprise about 35% by weight first particles and about 65% by weight second particles.

Importantly, the options for formulating a composition for consumers is flexible. For instance, the first particles and second particles may be produced on separate runs on the same manufacturing line or on separate manufacturing lines. The first particles and second particles can be mixed together prior to packaging in a single package to provide a mixture of first particles and second particles. The manufacturer can choose to balance the mixture of first particles and second particles to provide consumers with the desired scent benefit and softness benefit. The manufacture may even choose to provide a lineup of compositions having different levels of the first particles and second particles. For instance, the manufacturer can provide one composition that has a balance of first particles and second particles that is most consumer preferred, a second composition that is weighted towards providing a more noticeable scent benefit with less of a softness benefit, and a third composition that is weighted towards providing a more noticeable softness benefit with less of a scent benefit. This approach can allow the manufacturer to serve a variety of consumers' desires for benefits.

The composition can be used in process to launder articles of fabric in a washing machine. The process can comprise the steps as follows. Dispensing a composition comprising first particles and second particles into the washing machine. Dispensing a detergent composition comprising a surfactant into the washing machine, wherein the detergent composition is dispensed independently from the composition comprising first particles and second particles. Placing articles of fabric with the washing machine. Washing the fabric with a solution comprising the composition comprising first particles and second particles and the detergent composition. The detergent composition can comprise from about 15% to about 90% by weight surfactant. The composition comprising first particles and second particles can comprise less than 5% by weight surfactant. The composition comprising first particles and second particles can be dispensed before or after the detergent composition is dispensed.

The detergent composition can comprise a fully formulated laundry detergent composition. Fully formulated laundry detergent compositions can be products including, but not limited to, TIDE ORIGINAL liquid and TIDE ORIGINAL powder, manufactured by the Procter & Gamble Co., Cincinnati, Ohio, or similar such laundry detergent compositions. Fully formulated laundry detergent compositions typically comprise surfactant, perfume, brighteners, hueing dyes, and the like. The composition comprising first particles and second particles can be provided in a package separate from the package in which the detergent composition is provided.

The composition comprising first particles and second particles can be free of, substantially free of, or can comprise less than 5% by weight of the composition surfactant, or less than 1% by weight of the composition surfactant. Such composition of first particles and second particles may be easier to produce than particles having a higher level of surfactant.

The composition can comprise a mixture of first particles and second particles as described herein. The composition can be first particles and second particles packaged together. For example, the first particles and the second particles can be packaged together in a single chamber of package. The first particles and second particles can be packaged together in a package comprising a first chamber and a second chamber, wherein the first particles are within the first chamber of the package and the second particles are within the second chamber of the package.

Figure 2:
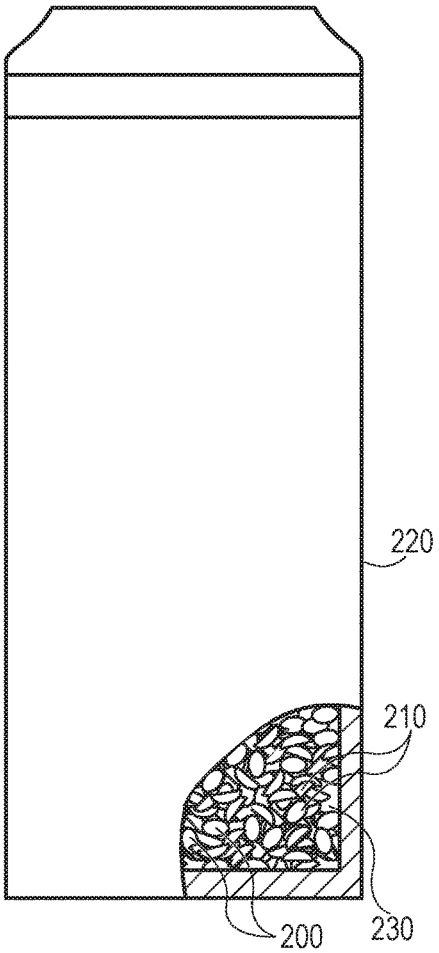
FIG. 2 is a package containing first particles and second particles in a single chamber.

The first particles 200 and second particles 210 can be packaged in a package 220, as shown in FIGS. 1 and 2. The first particles 200 and second particles 210 can be packaged in a first chamber 240 and second chamber 250, respectively, as shown in FIG. 1. The first particles 200 and the second particles 210 can be packaged in a single chamber 230 of the package 220, as shown in FIG. 2.

Silicone

The second particles can comprise about 0.1% to about 60% by weight of the second particles silicone. The second particles can comprise about 3% to about 50% by weight of the second particles silicone. The second particles can comprise about 10% to about 40% by weight of the second particles silicone. The second particles can comprise about 20% to about 35% by weight of the second particles silicone. The second particles can comprise about 28% to about 32% by weight of the second particles silicone.

The first particles can comprise less than 0.1% by weight of the first particles silicone. The first particles can comprise less than 1% by weight of the first particles silicone. The first particles can comprise less than 3% by weight of the first particles silicone.

Suitable silicones comprise Si—O moieties and may be selected from (a) non-functionalized siloxane polymers, (b) functionalized siloxane polymers, and combinations thereof. The molecular weight of the organosilicone is usually indicated by the reference to the viscosity of the material. In one aspect, the organosilicones may comprise a viscosity of from about 10 to about 2,000,000 centistokes at 25° C. In another aspect, suitable organosilicones may have a viscosity of from about 10 to about 800,000 centistokes at 25° C.

Suitable organosilicones may be linear, branched or cross-linked. In one aspect, the organosilicones may comprise silicone resins. Silicone resins are highly cross-linked polymeric siloxane systems. The cross-linking is introduced through the incorporation of trifunctional and tetrafunctional silanes with monofunctional or difunctional, or both, silanes during manufacture of the silicone resin. As used herein, the nomenclature SiO"n"/2 represents the ratio of oxygen and silicon atoms. For example, $SiO_{1/2}$ means that one oxygen is shared between two Si atoms. Likewise $SiO_{2/2}$ means that two oxygen atoms are shared between two Si atoms and $SiO_{3/2}$ means that three oxygen atoms are shared are shared between two Si atoms.

Silicone materials and silicone resins in particular, can conveniently be identified according to a shorthand nomenclature system known to those of ordinary skill in the art as "MDTQ" nomenclature. Under this system, the silicone is described according to presence of various siloxane monomer units which make up the silicone. Briefly, the symbol M denotes the monofunctional unit $(CH_3)_3SiO_{0.5}$; D denotes the difunctional unit $(CH_3)_2SiO$; T denotes the trifunctional unit $(CH_3)SiO_{1.5}$; and Q denotes the quadra- or tetra-functional unit $SiO_2$. Primes of the unit symbols (e.g. M', D', T', and Q') denote substituents other than methyl, and must be specifically defined for each occurrence.

Other modified silicones or silicone copolymers are also useful herein. Examples of these include silicone-based quaternary ammonium compounds (Kennan quats) disclosed in U.S. Pat. Nos. 6,607,717 and 6,482,969; end-terminal quaternary siloxanes; silicone aminopolyalkylene-oxide block copolymers disclosed in U.S. Pat. Nos. 5,807,956 and 5,981,681; hydrophilic silicone emulsions disclosed in U.S. Pat. No. 6,207,782; and polymers made up of one or more crosslinked rake or comb silicone copolymer segments disclosed in U.S. Pat. No. 7,465,439. Additional modified silicones or silicone copolymers useful herein are described in US Patent Publications 2007/0286837A1 and 2005/0048549A1.

In alternative embodiments of the present invention, the above-noted silicone-based quaternary ammonium compounds may be combined with the silicone polymers described in U.S. Pat. Nos. 7,041,767 and 7,217,777 and US Patent Publication 2007/0041929A1.

In one aspect, the organosilicone may comprise a non-functionalized siloxane polymer that may have the following formula, and may comprise polyalkyl and/or phenyl silicone fluids, resins and/or gums.

$$[R_1R_2R_3SiO_{1/2}]_n[R_4R_4SiO_{2/2}]_m[R_4SiO_{3/2}]_j$$

wherein:

i) each $R_1$, $R_2$, $R_3$ and $R_4$ may be independently selected from the group consisting of H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy, moieties;

ii) n may be an integer from about 2 to about 10, or from about 2 to about 6; or 2; such that n=j+2;

iii) m may be an integer from about 5 to about 8,000, from about 7 to about 8,000 or from about 15 to about 4,000;

iv) j may be an integer from 0 to about 10, or from 0 to about 4, or 0.

In one aspect, $R_2$, $R_3$ and $R_4$ may comprise methyl, ethyl, propyl, $C_4$-$C_{20}$ alkyl, and/or $C_6$-$C_{20}$ aryl moieties. In one aspect, each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy, and/or aryloxy.

In one aspect, the organosilicone may be polydimethylsiloxane, dimethicone, dimethiconol, dimethicone crosspolymer, phenyl trimethicone, alkyl dimethicone, lauryl dimethicone, stearyl dimethicone and phenyl dimethicone. Examples include those available under the names DC 200 Fluid, DC 1664, DC 349, DC 346G available from Dow Corning Corporation, Midland, Mich., and those available under the trade names SF1202, SF1204, SF96, and VISCASIL available from Momentive Silicones, Waterford, N.Y.

In one aspect, the organosilicone may comprise a cyclic silicone. The cyclic silicone may comprise a cyclomethicone of the formula $[(CH_3)_2SiO]_n$ where n is an integer that may range from about 3 to about 7, or from about 5 to about 6.

In one aspect, the organosilicone may comprise a functionalized siloxane polymer. Functionalized siloxane polymers may comprise one or more functional moieties selected from the group consisting of amino, amido, alkoxy, hydroxy, polyether, carboxy, hydride, mercapto, sulfate phosphate, and/or quaternary ammonium moieties. These moieties may be attached directly to the siloxane backbone through a bivalent alkylene radical, (i.e., "pendant") or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

In one aspect, the functionalized siloxane polymer may comprise a silicone polyether, also referred to as "dimethicone copolyol." In general, silicone polyethers comprise a polydimethylsiloxane backbone with one or more polyoxyalkylene chains. The polyoxyalkylene moieties may be incorporated in the polymer as pendent chains or as terminal blocks. Such silicones are described in US Patent Publication 2005/0098759, and U.S. Pat. Nos. 4,818,421 and 3,299,112. Exemplary commercially available silicone polyethers include DC 190, DC 193, FF400, all available from Dow Corning Corporation, and various SILWET surfactants available from Momentive Silicones.

In another aspect, the functionalized siloxane polymer may comprise an aminosilicone. Suitable aminosilicones are described in U.S. Pat. Nos. 7,335,630 B2, 4,911,852, and US Patent Publication 2005/0170994A1. In one aspect the aminosilicone may be that described in U.S. Provisional Patent Application 61/221,632. In another aspect, the aminosilicone may comprise the structure of the following formula:

$$[R_1R_2R_3SiO_{1/2}]_n[(R_4Si(X—Z)O_{2/2}]_k[R_4R_4SiO_{2/2}]_m[R_4SiO_{3/2}]_j$$

wherein:

i. $R_1$, $R_2$, $R_3$ and $R_4$ may each be independently selected from H, OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, and/or $C_1$-$C_{20}$ alkoxy;

ii. Each X may be independently selected from a divalent alkylene radical comprising 2-12 carbon atoms, —$(CH_2)$s- wherein s may be an integer from about 2 to about 10; —$CH_2$—CH(OH)—$CH_2$—; and/or

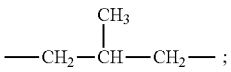

iii. Each Z may be independently selected from —$N(R_5)_2$;

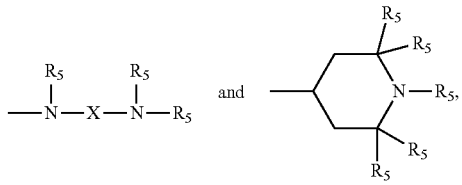

wherein each $R_5$ may be selected independently selected from H, $C_1$-$C_{20}$ alkyl; and $A^-$ may be a compatible anion. In one aspect, $A^-$ may be a halide;

iv. k may be an integer from about 3 to about 20, from about 5 to about 18 more or even from about 5 to about 10;

v. m may be an integer from about 100 to about 2,000, or from about 150 to about 1,000;

vi. n may be an integer from about 2 to about 10, or about 2 to about 6, or 2, such that n=j+2; and vii. j may be an integer from 0 to about 10, or from 0 to about 4, or 0.

In one aspect, $R_1$ may comprise —OH. In this aspect, the organosilicone is amidomethicone. Exemplary commercially available aminosilicones include DC 8822, 2-8177, and DC-949, available from Dow Corning Corporation, and KF-873, available from Shin-Etsu Silicones, Akron, Ohio.

In one aspect the silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

j is an integer from 0 to about 98; in one aspect j is an integer from 0 to about 48; in one aspect, j is 0;

k is an integer from 0 to about 200, in one aspect k is an integer from 0 to about 50; when k=0, at least one of $R_1$, $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubstituted divalent alkylene radical comprising 2-12 carbon atoms, in one aspect each divalent alkylene radical is independently selected from the group consisting of —$(CH_2)$s- wherein s is an integer from about 2 to about 8, from about 2 to about 4; in one aspect, each X in said alkyl siloxane polymer comprises a substituted divalent alkylene radical selected from the group consisting of: —$CH_2$—CH(OH)—$CH_2$—; —$CH_2$—$CH_2$—CH(OH)—; and

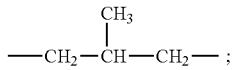

each Z is selected independently from the group consisting of

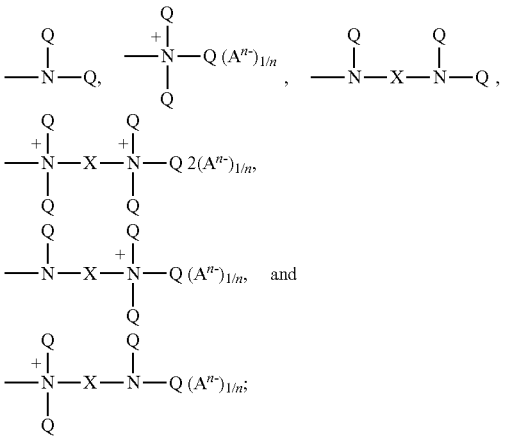

with the proviso that when Z is a quat, Q cannot be an amide, imine, or urea moiety;

for Z $A^{n-}$ is a suitable charge balancing anion. In one aspect $A^{n-}$ is selected from the group consisting of $Cl^-$, $Br^-$, $I^-$, methylsulfate, toluene sulfonate, carboxylate and phosphate; and at least one Q in said organosilicone is independently selected from —$CH_2$—CH(OH)—$CH_2$—$R_5$;

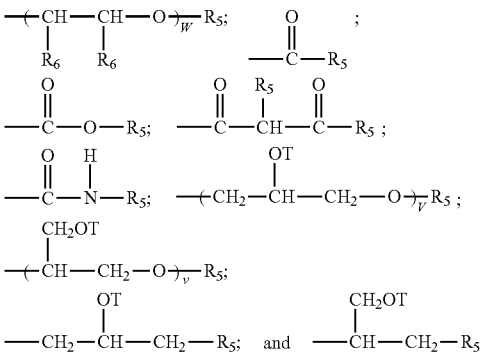

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

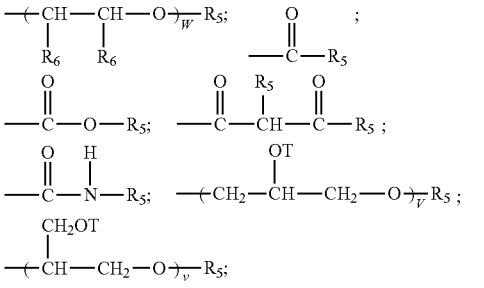

-continued

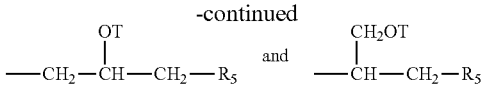

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6—CHR_6—O—)_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue; each T is independently selected from H, and

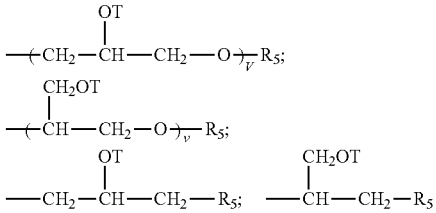

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

In one aspect, the organosilicone may comprise amine ABn silicones and quat ABn silicones. Such organosilicones are generally produced by reacting a diamine with an epoxide. These are described, for example, in U.S. Pat. Nos. 6,903,061, 5,981,681, 5,807,956, 6,903,061 and 7,273,837. These are commercially available under the trade names MAGNASOFT, PRIME, MAGNASOFT JSS, SILSOFT, and A-858, all from Momentive Silicones.

In another aspect, the functionalized siloxane polymer may comprise silicone-urethanes, such as those described in U.S. Provisional Patent Application 61/170,150. These are commercially available from Wacker Silicones under the trade name SLM-21200.

When a sample of organosilicone is analyzed, it is recognized by the skilled artisan that such sample may have, on average, the non-integer indices for Formula (I) and (II) above, but that such average indices values will be within the ranges of the indices for Formula (I) and (II) above.

The silicone can be an aminosilicone having the formula:

$$[R_1R_2R_3SiO_{1/2}]_{(j+2)}[(R_4Si(X—Z)O_{2/2}]_k[R_4R_4SiO_{2/2}]_k[R_4SiO_{3/2}]_j$$

wherein:

j is 0;

k is an integer from 1 to about 10;

m is an integer from 150 to about 1000; in one aspect m is an integer from about 325 to about 750; in another aspect m is an integer from about 400 to about 600;

each $R_1$, $R_2$ and $R_3$ is $C_1$-$C_{32}$ alkoxy and or $C_1$-$C_{32}$ alkyl;

each $R_4$ is $C_1$-$C_{32}$ alkyl each X is selected from the group consisting of —$(CH_2)_s$— wherein s is an integer from about 2 to about 8, from about 2 to about 4;

each Z is selected independently from the group consisting of

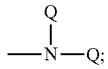

each Q in said silicone is selected from the group comprising of H;

The silicone can be an aminosilicone having the formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

j is 0;

k is an integer from 1 to about 10;

m is an integer from 150 to about 1000; in one aspect m is an integer from about 325 to about 750; in another aspect m is an integer from about 400 to about 600;

each $R_1$, $R_2$ and $R_3$ is $C_1$-$C_{32}$ alkoxy and or $C_1$-$C_{32}$ alkyl;

each $R_4$ is $C_1$-$C_{32}$ alkyl each X is selected from the group consisting of —$(CH_2)_s$— wherein s is an integer from about 2 to about 8, from about 2 to about 4;

each Z is selected independently from the group consisting of

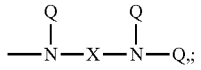

each Q in said silicone is selected from the group comprising of H;

The silicone can be an aminosilicone having the formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

j is 0;

k is an integer from 1 to about 5;

m is an integer from 250 to about 750; in one aspect m is an integer from about 325 to about 675; in another aspect m is an integer from about 400 to about 600;

each $R_1$, $R_2$ and $R_3$ is $C_1$-$C_{32}$ alkoxy and or $C_1$-$C_{32}$ alkyl;

each $R_4$ is $C_1$-$C_{32}$ alkyl each X is selected from the group consisting of —$(CH_2)_s$— wherein s is an integer from about 2 to about 8, from about 2 to about 4;

each Z is selected independently from the group consisting of

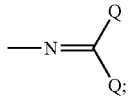

each additional Q in said silicone is independently selected from the group consisting of H, C1-C32 alkyl, C1-C32 substituted alkyl, C6-C32 aryl, C5-C32 substituted aryl, C6-C32 alkylaryl, C5-C32 substituted alkylaryl; with the proviso that both Q cannot be H atoms.

The silicone can be mixed with the second carrier. The silicone can be dispersed in the second carrier. The silicone can be dispersed in the second carrier as droplets. The mean particle size of the silicone disposed in the second carrier material can be from about 2 μm to about 2000 μm. The mean particle size of the silicone disposed in the second carrier is determined according to the MEAN PARTICLE SIZE method described herein below.

The optimal mean particle size of the silicone may depend upon the intended use of the composition. For instance, a fabric softening product composition for conditioning fabrics in a laundry process may contain silicone having a mean particle size of from about 2 μm to about 500 μm, or from about 2 μm to about 120 μm, or from about 2 μm to about 70 μm. Droplets of silicone that are too small may not adequately deposit onto fibers of the fabric items being washed. Droplets of silicone that are too large may result in spotting of the fibers of the fabric items.

Since the composition is in a solid form, the particle size of the silicone will generally remain constant during packaging, shipping and storage of the composition.

The silicone can be dimethyl, methyl (3-aminopropyl) siloxane, trimethylsiloxy-terminated, CAS-No. 99363-37-8, available from Dow Corning as Dow Corning as DOW CORNING® XX-8766 AMINO POLYMER, product code 000000000004121334. An exemplary silicone can be the following formula.

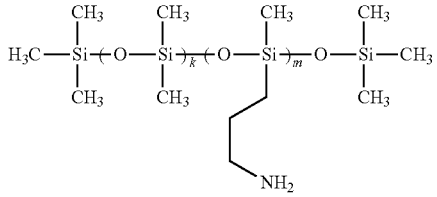

The silicone can be an aminosilicone having the following formula:

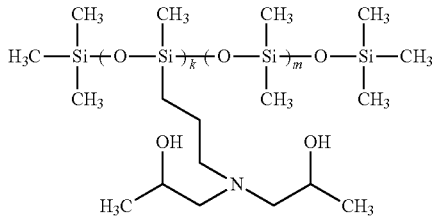

The silicone can be an anionic silicone. Examples of anionic silicones are silicones that incorporate carboxylic, sulphate, sulphonic, phosphate and/or phosphonate functionality. The anionic silicone may be in the form of the acid or the anion. For example for the carboxyl functionalised silicone, it may be present as a carboxylic acid or carboxylate anion. The anionic silicone can have a molecular weight of from 1,000 to 100,000, or from 2,000 to 50,000, or even more from 5,000 to 50,000, or even from 10,000 to 50,000.

Particles

Optionally, for any of the compositions and particles disclosed herein, whether they be first particles or second particles, individual particles can have a mass of from about 1 mg to about 5000 mg, alternatively from about 5 mg to about 1000 mg, alternatively from about 5 mg to about 200 mg, alternatively from about 10 mg to about 100 mg, alternatively from about 20 mg to about 50 mg, alternatively from about 35 mg to about 45 mg, alternatively about 38 mg, alternatively combinations thereof and any whole numbers or ranges of whole numbers of mg within any of the aforementioned ranges. First particles and or second particles having a mass in the aforesaid ranges can have dissolution times in water that permit the particles to dissolve during a typical wash cycle. Individual first particles and or second particles can have a shape selected from the group consisting of spherical, hemispherical, compressed hemispherical, lentil shaped, and oblong.

The first particles and or second particles can have a mean particle mass of from about 1 mg to about 5000 mg, alternatively from about 5 mg to about 1000 mg, alternatively from about 5 mg to about 200 mg, alternatively from about 10 mg to about 100 mg, alternatively from about 20 mg to about 50 mg, alternatively from about 35 mg to about 45 mg, alternatively about 38 mg. The first particles and or second particles can have a standard deviation of mass of less than 30 mg, alternatively less than 15 mg, alternatively less than 5 mg, alternatively about 3 mg. The mean particle mass within the aforesaid ranges can provide for a dissolution time in water that permits the particles to dissolve during a typical wash cycle. Without being bound by theory, it is thought that first particles and or second particles having such a standard deviation of mass can have a more uniform dissolution time in water as compared to particles having a broader standard deviation of mass. The smaller the standard deviation of mass of the particles the more uniform the dissolution time is expected to be. The mass of the individual first particles and or second particles can be set to provide the desired dissolution time, which might be some fraction of the length of the typical washing cycle in a washing machine. Particles formed from polyethylene glycol having a weight average molecular weight of about 9000 can have mean particle mass of about 38 mg and standard deviation of mass of about 3 mg. For clarity, the aforesaid disclosure on mean particle size is meant to apply individually to the first particles, individually to the second particles, and to the mixture of first particles and second particles.

An individual first particle or second particle may have a volume from about 0.003 $cm^3$ to about 5 $cm^3$, alternatively from about 0.003 $cm^3$ to about 1 $cm^3$, alternatively from about 0.003 $cm^3$ to about 0.5 $cm^3$, alternatively from about 0.003 $cm^3$ to about 0.2 $cm^3$, alternatively from about 0.003 $cm^3$ to about 0.15 $cm^3$. Smaller particles are thought to provide for better packing of the particles in a package and faster dissolution in the wash. For clarity, the aforesaid disclosure on volume of individual particles is meant to apply individually to the first particles, individually to the second particles, and to the mixture of first particles and second particles.

The composition can comprise first particles and or second particles that are retained on a number 10 sieve as specified by ASTM International, ASTM E11-13. The composition can comprise first particles and or second particles wherein more than 50% by weight of the particles are retained on a number 10 sieve as specified by ASTM International, ASTM E11-13. The composition can comprise first particles and or second particles wherein more than 70% by weight of the particles are retained on a number 10 sieve as specified by ASTM International, ASTM E11-13. The composition can comprise first particles and or second particles wherein more than 90% by weight of the particles are retained on a number 10 sieve as specified by ASTM International, ASTM E11-13. For clarity, the aforesaid disclosure on particles retained on a number 10 sieve is meant to apply individually to the first particles, individually to the second particles, and to the mixture of first particles and second particles. It can be desirable to provide particles sized as such because particles retained on a number 10 sieve may be easier to handle than smaller particles.

The composition can comprise first particles and or second particles that are retained on a number 6 sieve as specified by ASTM International, ASTM E11-13. The composition can comprise first particles and or second particles wherein more than 50% by weight of the particles are retained on a number 6 sieve as specified by ASTM International, ASTM E11-13. The composition can comprise first particles and or second particles wherein more than 70% by weight of the particles are retained on a number 6 sieve as specified by ASTM International, ASTM E11-13. The composition can comprise first particles and or second particles wherein more than 90% by weight of the particles are retained on a number 6 sieve as specified by ASTM International, ASTM E11-13. It can be desirable to provide first particles and or second particles sized as such because particles retained on a number 6 sieve may be easier to handle than smaller particles.

The composition can comprise first particles and or second particles that pass a sieve having a nominal sieve opening size of 22.6 mm. The composition can comprise first particles and or second particles that pass a sieve having a nominal sieve opening size of 22.6 mm and are retained on a sieve having a nominal sieve opening size of 0.841 mm. First particles and or second particles having a size such that they are retained on a sieve having a nominal opening size of 22.6 mm may tend to have a dissolution time that is too great for a common wash cycle. First particles and or second particles having a size such that they pass a sieve having a nominal sieve opening size of 0.841 mm may be too small to conveniently handle. First particles and or second particles having a size within the aforesaid bounds may represent an appropriate balance between dissolution time and ease of particle handling.

First particles and or second particles having the size disclosed herein can be substantial enough so that they do not readily become airborne when poured from a package, dosing cup, or other apparatus, into a wash basin or washing machine. Further, such first particles and or second particles as disclosed herein can be easily and accurately poured from a package into a dosing cup.

A plurality of first particles and or second particles may collectively comprise a dose for dosing to a laundry washing machine or laundry wash basin. A single dose of the particles may comprise from about 1 g to about 27 g of first particles and or second particles. A single dose of the first particles and or second particles may comprise from about 5 g to about 27 g, alternatively from about 13 g to about 27 g, alternatively from about 14 g to about 20 g, alternatively from about 15 g to about 19 g, alternatively from about 18 g to about 19 g, alternatively combinations thereof and any whole numbers of grams or ranges of whole numbers of grams within any of the aforementioned ranges. The individual first particles and or second particles forming the plurality of particles that can make up the dose can have a mass from about 1 mg to about 5000 mg, alternatively from about 5 mg to about 1000 mg, alternatively from about 5 mg to about 200 mg, alternatively from about 10 mg to about 100 mg, alternatively from about 20 mg to about 50 mg, alternatively from about 35 mg to about 45 mg, alternatively about 38 mg, alternatively combinations thereof and any whole numbers or ranges of whole numbers of mg within any of the aforementioned ranges. The plurality of first particles and or second particles can be made up of particles having different size, shape, and/or mass. The first particles and or second particles in a dose can each have a maximum dimension less than 15 mm. Each of the first particles and or second particles in a dose can have a maximum dimension less than 1 cm.

The first particles and or second particles disclosed herein can be conveniently employed to treat laundry articles. The steps of the process can be to provide such first particles and or second particles comprising the formulation components disclosed herein. A dose of the first particles and or second particles can be placed in a dosing cup. The dosing cup can be the closure of a package containing the particles. The dosing cup can be a detachable and attachable dosing cup that is detachable and attachable to a package containing the first particles and or second particles or to the closure of such package. The dose of first particles and or second particles in the dosing cup can be dispensed into a washing machine. The step of dispensing the particles in the washing machine can take place by pouring the first particles and or second particles into the washing machine or placing the dosing cup and the particles contained therein into the washing machine.

The composition of first particles and second particles disclosed herein can be convenient for the consumer to dose into a washing machine. For instance, the consumer can pour the composition from a package that contains the first particles and second particles. The first particles and second particles can be a mixture of such particles in a single chamber of the package. The first particles can be in a first chamber of the package and the second particles can be in a second chamber of the package.

Optionally, the consumer can pour the first particles and second particles into a measuring cup that is separate from the package or in which the composition is provided or into a measuring cup that is part of the package in which the composition is provided. The measuring cup can be a closure of the package in which the composition is provided. The measuring cup can be attachable and detachable from the closure of the package in which the composition is provided.

The composition of the mixture of first particles and second particles can have a coefficient of uniformity of less than 2. Having a coefficient of uniformity of less than 2 can help reduce the potential for the particles when packaged together in a single chamber of a package to segregate as compared to mixtures of particles having a coefficient of uniformity greater than 2. Particle size, coefficient of uniformity, D50, and D10, as discussed further below, are measured according to ASTM D6913-04(2009)e1.

The composition can be such that the first particles have a first particles D50 and the second particles have a second particles D50, wherein the second particles D50 is within about 20% of the first particles D50. The composition can be such that the first particles have a first particles D50 and the second particles have a second particles D50, wherein the second particles D50 is within about 10% of the first particles D50. The composition can be such that the first particles have a first particles D50 and the second particles have a second particles D50, wherein the second particles D50 is within about 5% of the first particles D50. Having the D50 of the first particles and the second particles related as such can be practical for simplifying processing of the first particles and the second particles and mixing the two, with smaller differences in D50 meaning that the first particles and second particles are more similarly shaped to one another and easier to manufacture, mix, and store. Further, having the first particles and second particles have similar D50 sizes can help reduce the potential for the first particles and second particles to segregate once mixed or packaged together in a single chamber of a package, with the potential being reduced as the difference in D50 between the respective particles decreases.

Depending on the carrier materials employed, there is potential for silicone from the second particles to migrate into the first particles. Similarly, there is the potential for perfume in first particles to migrate into the second particles. The second particles have a weight fraction of silicone greater than the weight fraction of silicon in the first particles and the weight fraction of silicone in the first particles can be about zero or zero. Stated similarly, the weight fraction of silicone in the second particles is greater than the weight fraction of silicone in the first particles, the weight fraction of silicone in the first particles being as low as about zero or zero.

The first particles can have less than 5% by weight of the first particles of silicone. The first particles can have less than about 2% by weight of the first particles of silicone. The first particles can have less than about 1% by weight of the first particles of silicone.

Water Soluble Carrier

The water soluble first carrier and water soluble second carrier can be or comprise a material selected from the group consisting of water soluble inorganic alkali metal salt, water-soluble alkaline earth metal salt, water-soluble organic alkali metal salt, water-soluble organic alkaline earth metal salt, water soluble carbohydrate, water-soluble silicate, water soluble urea, and any combination thereof. The water soluble first carrier and the water soluble second carrier can both be the same material or different materials. Alkali metal salts can be, for example, selected from the group consisting of salts of lithium, salts of sodium, and salts of potassium, and any combination thereof. Useful alkali metal salts can be, for example, selected from the group consisting of alkali metal fluorides, alkali metal chlorides, alkali metal bromides, alkali metal iodides, alkali metal sulfates, alkali metal bisulfates, alkali metal phosphates, alkali metal monohydrogen phosphates, alkali metal dihydrogen phosphates, alkali metal carbonates, alkali metal monohydrogen carbonates, alkali metal acetates, alkali metal citrates, alkali metal lactates, alkali metal pyruvates, alkali metal silicates, alkali metal ascorbates, and combinations thereof.

Alkali metal salts can be selected from the group consisting of, sodium fluoride, sodium chloride, sodium bromide, sodium iodide, sodium sulfate, sodium bisulfate, sodium phosphate, sodium monohydrogen phosphate, sodium dihydrogen phosphate, sodium carbonate, sodium hydrogen carbonate, sodium acetate, sodium citrate, sodium lactate, sodium tartrate, sodium silicate, sodium ascorbate, potassium fluoride, potassium chloride, potassium bromide, potassium iodide, potassium sulfate, potassium bisulfate, potassium phosphate, potassium monohydrogen phosphate, potassium dihydrogen phosphate, potassium carbonate, potassium monohydrogen carbonate, potassium acetate, potassium citrate, potassium lactate, potassium tartrate, potassium silicate, potassium, ascorbate, and combinations thereof. Alkaline earth metal salts can be selected from the group consisting of salts of magnesium, salts of calcium, and the like, and combinations thereof. Alkaline earth metal salts can be selected from the group consisting of alkaline metal fluorides, alkaline metal chlorides, alkaline metal bromides, alkaline metal iodides, alkaline metal sulfates, alkaline metal bisulfates, alkaline metal phosphates, alkaline metal monohydrogen phosphates, alkaline metal dihydrogen phosphates, alkaline metal carbonates, alkaline metal monohydrogen carbonates, alkaline metal acetates, alkaline metal citrates, alkaline metal lactates, alkaline metal pyruvates, alkaline metal silicates, alkaline metal ascorbates, and combinations thereof. Alkaline earth metal salts can be selected from the group consisting of magnesium fluoride, magnesium chloride, magnesium bromide, magnesium iodide, magnesium sulfate, magnesium phosphate, magnesium monohydrogen phosphate, magnesium dihydrogen phosphate, magnesium carbonate, magnesium monohydrogen carbonate, magnesium acetate, magnesium citrate, magnesium lactate, magnesium tartrate, magnesium silicate, magnesium ascorbate, calcium fluoride, calcium chloride, calcium bromide, calcium iodide, calcium sulfate, calcium phosphate, calcium monohydrogen phosphate, calcium dihydrogen phosphate, calcium carbonate, calcium monohydrogen carbonate, calcium acetate, calcium citrate, calcium lactate, calcium tartrate, calcium silicate, calcium ascorbate, and combinations thereof. Inorganic salts, such as inorganic alkali metal salts and inorganic alkaline earth metal salts, do not contain carbon. Organic salts, such as organic alkali metal salts and organic alkaline earth metal salts, contain carbon. The organic salt can be an alkali metal salt or an alkaline earth metal salt of sorbic acid (i.e., asorbate). Sorbates can be selected from the group consisting of sodium sorbate, potassium sorbate, magnesium sorbate, calcium sorbate, and combinations thereof.

The water soluble first carrier and water soluble second carrier can be or comprise a material selected from the group consisting of a water-soluble inorganic alkali metal salt, a water-soluble organic alkali metal salt, a water-soluble inorganic alkaline earth metal salt, a water-soluble organic alkaline earth metal salt, a water-soluble carbohydrate, a water-soluble silicate, a water-soluble urea, and combinations thereof. The water soluble first carrier and water soluble second carrier can be selected from the group consisting of sodium chloride, potassium chloride, calcium chloride, magnesium chloride, sodium sulfate, potassium sulfate, magnesium sulfate, sodium carbonate, potassium carbonate, sodium hydrogen carbonate, potassium hydrogen carbonate, sodium acetate, potassium acetate, sodium citrate, potassium citrate, sodium tartrate, potassium tartrate, potassium sodium tartrate, calcium lactate, water glass, sodium silicate, potassium silicate, dextrose, fructose, galactose, isoglucose, glucose, sucrose, raffinose, isomalt, xylitol, candy sugar, coarse sugar, and combinations thereof. In one embodiment, the first water soluble carrier and/or the second water soluble carrier can be sodium chloride. In one embodiment, the first water soluble carrier and second water soluble carrier can be table salt.

The first water soluble carrier and second water soluble carrier can be or comprise a material selected from the group consisting of sodium bicarbonate, sodium sulfate, sodium carbonate, sodium formate, calcium formate, sodium chloride, sucrose, maltodextrin, corn syrup solids, corn starch, wheat starch, rice starch, potato starch, tapioca starch, clay, silicate, citric acid carboxymethyl cellulose, fatty acid, fatty alcohol, glyceryl diester of hydrogenated tallow, glycerol, and combinations thereof. The first water soluble carrier and the second water soluble carrier can be the same material or different materials. Employing the same water soluble carrier for the first water soluble carrier and second water soluble carrier can be practical for simplifying the manufacturer's supply chain and allowing the manufacturer to apply learnings from the manufacture of one of the particles to the other particles. Using different materials for the first water soluble carrier and the second water soluble carrier can be practical for providing different dissolution behavior in the wash, different tactile feel to the particles, different visual impression of the particles, and for enabling the consumer to recognize that the composition she is using comprises two different kinds of particles.

The first water soluble carrier and second water soluble carrier can be selected from the group consisting of water soluble organic alkali metal salt, water soluble inorganic alkaline earth metal salt, water soluble organic alkaline earth metal salt, water soluble carbohydrate, water soluble silicate, water soluble urea, starch, clay, water insoluble silicate, citric acid carboxymethyl cellulose, fatty acid, fatty alcohol, glyceryl diester of hydrogenated tallow, glycerol, polyethylene glycol, and combinations thereof.

The first water soluble carrier and second water soluble carrier can be selected from the group consisting of disaccharides, polysaccharides, silicates, zeolites, carbonates, sulfates, citrates, and combinations thereof.

The first water soluble carrier and second water soluble carrier can be a water soluble polymer. Examples of water soluble polymers include but are not limited to polyvinyl alcohols (PVA), modified PVAs; polyvinyl pyrrolidone; PVA copolymers such as PVA/polyvinyl pyrrolidone and PVA/polyvinyl amine; partially hydrolyzed polyvinyl acetate; polyalkylene oxides such as polyethylene oxide; polyethylene glycols; acrylamide; acrylic acid; cellulose, alkyl cellulosics such as methyl cellulose, ethyl cellulose and propyl cellulose; cellulose ethers; cellulose esters; cellulose amides; polyvinyl acetates; polycarboxylic acids and salts; polyaminoacids or peptides; polyamides; polyacrylamide; copolymers of maleic/acrylic acids; polysaccharides including starch, modified starch; gelatin; alginates; xyloglucans, other hemicellulosic polysaccharides including xylan, glucuronoxylan, arabinoxylan, mannan, glucomannan and galactoglucomannan; and natural gums such as pectin, xanthan, and carrageenan, locus bean, arabic, tragacanth; and combinations thereof. In one embodiment the polymer comprises polyacrylates, especially sulfonated polyacrylates and water-soluble acrylate copolymers; and alkylhydroxy cellulosics such as methylcellulose, carboxymethylcellulose sodium, modified carboxy-methylcellulose, dextrin, ethylcellulose, propylcellulose, hydroxyethyl cellulose, hydroxypropyl methylcellulose, maltodextrin, polymethacrylates. In yet another embodiment the polymer comprises PVA; PVA copolymers; hydroxypropyl methyl cellulose (HPMC); and mixtures thereof.

The first carrier and second carrier can be selected from the group consisting of polyvinyl alcohol, modified polyvinyl alcohol, polyvinyl pyrrolidone, polyvinyl alcohol/polyvinyl pyrrolidone, polyvinyl alcohol/polyvinyl amine, partially hydrolyzed polyvinyl acetate, polyalkylene oxide, polyethylene glycol, acrylamide, acrylic acid, cellulose, alkyl cellulosics, methyl cellulose, ethyl cellulose, propyl cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides, starch, modified starch, gelatin, alginates, xyloglucans, hemicellulosic polysaccharides, xylan, glucuronoxylan, arabinoxylan, mannan, glucomannan, galactoglucomannan, natural gums, pectin, xanthan, carrageenan, locus bean, arabic, tragacanth, polyacrylates, sulfonated polyacrylates, water-soluble acrylate copolymers, alkylhydroxy cellulosics, methylcellulose, carboxymethylcellulose sodium, modified carboxy-methylcellulose, dextrin, ethylcellulose, propylcellulose, hydroxyethyl cellulose, hydroxypropyl methylcellulose, maltodextrin, polymethacrylates, polyvinyl alcohol copolymers, hydroxypropyl methyl cellulose, and mixtures thereof.

The first carrier and second carrier can be an organic material. Organic carriers may provide a benefit of being readily soluble in water.

The first particles can comprise from about 30% by weight to about 98% by weight of the particles of the water soluble first carrier. The second particles can comprise from about 30% by weight to about 98% by weight of the second particles of the water soluble second carrier. The first particles and second particles can comprise from about 45% by weight to about 99% by weight of the respective particles of a water soluble carrier, understood to be the water soluble first carrier and the water soluble second carrier. The first particles and second particles can comprise from about 45% by weight to about 92% by weight of the respective particles of a water soluble carrier, understood to be the water soluble first carrier and the water soluble second carrier. The first particles and second particles can comprise from about 40% by weight to about 99% by weight of the respective particles of a water soluble carrier, understood to be the water soluble first carrier and the water soluble second carrier.

The water soluble first carrier and water soluble second carrier can be polyethylene glycol (PEG). PEG can be a convenient material to employ to make particles because it can be sufficiently water soluble to dissolve during a wash cycle when the first particles and second particles are within the aforesaid range of mass. Further, PEG can be easily processed as melt. The onset of melt temperature of PEG can vary as a function of molecular weight of the PEG.

The first particles and second particles can comprise more than about 40% by weight PEG having a weight average molecular weight from about 2000 to about 13000. PEG has a relatively low cost, may be formed into many different shapes and sizes, minimizes unencapsulated perfume diffusion, and dissolves well in water. PEG comes in various weight average molecular weights. A suitable weight average molecular weight range of PEG includes from about 2,000 to about 13,000, from about 4,000 to about 12,000, alternatively from about 5,000 to about 11,000, alternatively from about 6,000 to about 10,000, alternatively from about 7,000 to about 9,000, alternatively combinations thereof. PEG is available from BASF, for example PLURIOL E 8000, or PLURIOL E 9000, or other PLURIOL product.

The first particles and second particles can comprise more than about 40% by weight of the particles of PEG. The first particles and second particles can comprise more than about 50% by weight of the particles of PEG. The first particles and second particles can comprise more than about 60% by weight of the particles of PEG. The first particles and second particles may comprise from about 40% to about 99% by weight of the composition of PEG. The first particles and second particles may comprise from about 65% to about 99% by weight of the composition of PEG. The first particles and second particles may comprise from about 40% to about 99% by weight of the composition of PEG. The first particles and second particles may comprise from about 45% to about 99% by weight of the composition of PEG.

Alternatively, the first particles and second particles can comprise from about 40% to about 90%, alternatively from about 45% to about 75%, alternatively from about 50% to about 70%, alternatively combinations thereof and any whole percentages or ranges of whole percentages within any of the aforementioned ranges, of PEG by weight of the respective particles.

The plurality of first particles and second particles can be substantially free from particles having a mass less than 10 mg. This can be practical for limiting the ability of the first particles and or second particles to become airborne.

Depending on the application, the first particles and second particles can comprise from about 0.5% to about 5% by weight of the respective particles of a balancing agent selected from the group consisting of glycerin, polypropylene glycol, isopropyl myristate, dipropylene glycol, 1,2-propanediol, and PEG having a weight average molecular weight less than 2,000, and mixtures thereof. The balancing agent can be practical for providing particles having the same processing characteristics even though the particles have different formulations. For instance, two different scent variants of a product may have different levels of perfume. With use of a balancing agent, the PEG level can be the same in each scent variant and the formulas can be balanced with the balancing agent. This can make processing simpler in that the formulas for the scent variants will have the same level of PEG and may have similar processing characteristics.

The first particles and second particles can comprise an antioxidant. The antioxidant can help to promote stability of the color and or odor of the respective particles over time between production and use. The first particles and or second particles can comprise between about 0.01% to about 1% by weight antioxidant. The first particles and or second particles can comprise between about 0.001% to about 2% by weight antioxidant. The first particles and or second particles can comprise between about 0.01% to about 0.1% by weight antioxidant. The antioxidant can be butylated hydroxytoluene.

The first carrier and the second carrier can comprise a water soluble polymer. Water soluble polymers can be relatively easily processed with other formulation components that make up the first particles and second particles.

The first carrier and second carrier can be the same water soluble polymer or different water soluble polymers. For first particles and second particles processed as a melt, it can be convenient to have the first carrier and the second carrier be the same material. This can be a convenient enabler for manufacturing the first particles and the second particles on the same or similar manufacturing equipment using the same or similar processing settings, such as temperature, line speed, liquid controls, and the like.

Further, if the same or similar materials are used as the water soluble first carrier and the water soluble second carrier, the dissolution behavior of the carriers in the wash can be consistent amongst the first particles and second particles. For instance, if the first particles comprise a water soluble first carrier that is PEG having a particular distribution of molecular weights and the second particles comprise a water soluble second carrier that is the same as the water soluble first carrier, the dissolution behavior of the first particles and the second particles in the wash are expected to be similar. If the first particles and the second particles are similarly sized to one another, then the first particles and second particles are expected to dissolve in the wash within similar amounts of time.

The water soluble first carrier and water soluble second carrier can comprise a monomer present in both the first carrier and the second carrier. For instance, the first carrier and the second carrier can comprise the same monomer, but the carriers may have different molecular weight distributions. Different molecular weight distributions can be used to control the amount of time it takes for the particles to dissolve in the wash. Different molecular weight distributions may also be used to obtain advantages or avoid difficulties during manufacturing.

The onset of melt of the first particles and the second particles can differ by less than 40° C. This difference being so small can be practical for manufacturing in that it might be possible to manufacture the first particles and the second particles on the same manufacturing equipment with little or no modification required in the equipment setup being required as part of the change over process. Similarly, if the first particles and second particles are manufactured on separate equipment, the process settings can be the same or similar for both pieces of equipment. Furthermore, expertise that is gained on manufacturing the first particles may be applied to manufacturing the second particles, and vice versa. The onset of melt of the first particles and the second particles can differ by less than 20° C.

The water soluble first carrier and water soluble second carrier can disperse completely in 25° C. water within a Dispersion Time of less than 60 minutes. The water soluble first carrier and water soluble second carrier can disperse completely in 25° C. water within a Dispersion Time of less than 20 minutes. The water soluble first carrier and water soluble second carrier can disperse completely in 25° C. water within a Dispersion Time of less than 10 minutes. The water soluble first carrier and water soluble second carrier can disperse completely in 25° C. water within a Dispersion Time of less than 4 minutes. The water soluble first carrier and water soluble second carrier can disperse completely in 25° C. water within a Dispersion Time of less than 2 minutes. The water soluble first carrier and water soluble second carrier can disperse completely in 25° C. water within a Dispersion Time of less than 1 minute. The Dispersion Time is determined according to the DISPERSION TEST METHOD described herein. For shorter wash cycles, particles having a shorter Dispersion Time may preferable.

The first particles and second particles can have different Dispersion Times. For instance, the first particles can have a Dispersion Time that is shorter or longer than the Dispersion Time of the second particles. It can be practical to have the first particles have a shorter Dispersion Time than the second particles. This can provide early room bloom of perfume as the first particles disperse in the wash and then significant release of silicone from the second particles to be deposited on the fabric. If for certain wash conditions, cycles, silicone, and perfumes it is desirable for the silicone to be released before the perfume, then the second particles can have a shorter Dispersion Time than the first particles.

Dye

The first particles and or second particles may comprise dye. The dye may include those dyes that are typically used in laundry detergent or fabric softeners. The fabric treatment composition may comprise less than 0.1%, alternatively about 0.001% to about 0.1%, alternatively about 0.01% to about 0.02%, alternatively combinations thereof and any hundredths of percent or ranges of hundredths of percent within any of the aforementioned ranges, of dye by weight of the particles of fabric treatment composition. Examples of suitable dyes include, but are not limited to, LIQUITINT PINK AM, AQUA AS CYAN 15, and VIOLET FL, available from Milliken Chemical. Employing a dye can be practical to help the user differentiate between particles having differing scents and the first particles and second particles, by using different colored dyes for the respective particles, if desired.

Perfume

In addition to the first carrier, the first particles can further comprise 0.1% to about 20% by weight perfume. The perfume can be unencapsulated perfume, encapsulated perfume, perfume provided by a perfume delivery technology, or a perfume provided in some other manner. Perfumes are generally described in U.S. Pat. No. 7,186,680 at column 10, line 56, to column 25, line 22. The particles can comprise unencapsulated perfume and are essentially free of perfume carriers, such as a perfume encapsulate. The particles can comprise perfume carrier materials (and perfume contained therein). Examples of perfume carrier materials are described in U.S. Pat. No. 7,186,680, column 25, line 23, to column 31, line 7. Specific examples of perfume carrier materials may include cyclodextrin and zeolites.

The particles can comprise about 0.1% to about 20%, alternatively about 1% to about 15%, alternatively about 2% to about 10%, alternatively combinations thereof and any whole percentages within any of the aforementioned ranges, of perfume by weight of the first particles. The first particles can comprise from about 0.1% by weight to about 6% by weight of the first particles of perfume. The perfume can be unencapsulated perfume and or encapsulated perfume.

The first particles can be free or substantially free of a perfume carrier. The first particles may comprise about 0.1% to about 20%, alternatively about 1% to about 15%, alternatively 2% to about 10%, alternatively combinations thereof and any whole percentages within any of the aforementioned ranges, of unencapsulated perfume by weight of the first particles.

The first particles can comprise unencapsulated perfume and encapsulated perfume. The first particles may comprise about 0.1% to about 20%, alternatively about 1% to about 15%, alternatively from about 2% to about 10%, alternatively combinations thereof and any whole percentages or ranges of whole percentages within any of the aforementioned ranges, of the unencapsulated perfume by weight of the first particles. Such levels of unencapsulated perfume can be appropriate for any of the first particles disclosed herein that have unencapsulated perfume.

The first particles can comprise unencapsulated perfume and encapsulated perfume but be free or essentially free of other perfume carriers. The first particles can comprise unencapsulated perfume and encapsulated perfume and be free of other perfume carriers.

The first particles can comprise encapsulated perfume. Encapsulated perfume can be perfume oil enclosed within a shell wall. The shell wall can have an average shell thickness less than the maximum dimension of the perfume core. The encapsulated perfume can be a friable perfume encapsulate. A friable perfume encapsulate is a encapsulated perfume in which the shell has low water solubility or is not water soluble. The perfume encapsulate can be a moisture activated perfume encapsulate. The perfume encapsulate can comprise a melamine/formaldehyde shell. Perfume encapsulates may be obtained from Encapsys, or International Flavor & Fragrances, or other suitable source. The perfume encapsulate shell can be coated with polymer to enhance the ability of the perfume encapsulate to adhere to fabric. This can be desirable if the first particles are designed to be a fabric treatment composition. The perfume encapsulate can be those described in U.S. Patent Publication 2008/0305982.

The first particles can comprise about 0.1% to about 20%, alternatively about 0.1% to about 10%, alternatively about 1% to about 15%, alternatively 2% to about 10%, alternatively combinations thereof and any whole percentages within any of the aforementioned ranges, of encapsulated perfume by weight of the first particles.

The first particles can comprise perfume encapsulate but be free of or essentially free of unencapsulated perfume. The first particles may comprise about 0.1% to about 20%, alternatively about 1% to about 15%, alternatively about 2% to about 10%, alternatively combinations thereof and any whole percentages within any of the aforementioned ranges, of encapsulated perfume by weight of the first particles.

Method of Making Particles

Figure 3:
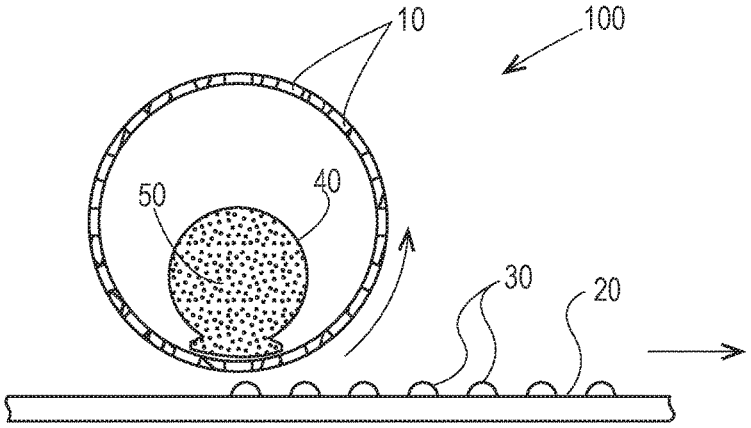
FIG. 3 is an apparatus for forming particles.

An apparatus 1 for forming first and second particles is shown in FIG. 3. The raw material or raw materials are provided to a mixer 10. The mixer 10 has sufficient capacity to retain the volume of raw materials provided thereto for a sufficient residence time to permit the desired level of mixing and or reaction of the raw materials. The material leaving the mixer 10 is the precursor material 20. The precursor material 20 can be a molten product. The mixer 10 can be a dynamic mixer. A dynamic mixer is a mixer to which energy is applied to mix the contents in the mixer. The mixer 10 can comprise one or more impellers to mix the contents in the mixer 10.

Between the mixer 10 and the distributor 30, the precursor material 20 can be transported through the feed pipe 40. The feed pipe 40 can be in fluid communication with the mixer 10. An intermediate mixer 55 can be provided in fluid communication with the feed pipe 40 between the mixer 10 and the distributor 30. The intermediate mixer 55 can be a static mixer 50 in fluid communication with the feed pipe 40 between the mixer 10 and the distributor 30. The intermediate mixer 55, which can be a static mixer 50, can be downstream of the mixer 10. Stated otherwise, the mixer 10 can be upstream of the intermediate mixer 55 or static mixer 55 if employed. The intermediate mixer 55 can be a static mixer 50. The intermediate mixer 55 can be a rotor-stator mixer. The intermediate mixer 55 can be a colloid mill. The intermediate mixer 55 can be a driven in-line fluid disperser. The intermediate mixer 55 can be an Ultra Turrax disperser, Dispax-reactor disperser, Colloid Mil MK, or Cone Mill MKO, available from IKA, Wilmington, N.C., United States of America. The intermediate mixer 55 can be a perforated disc mill, toothed colloid mill, or DIL Inline Homogenizer, available from FrymaKoruma, Rheinfelden, Switzerland.

The distributor 30 can be provided with a plurality of apertures 60. The precursor material 20 can be passed through the apertures 60. After passing through the apertures 60, the precursor material 20 can be deposited on a moving conveyor 80 that is provided beneath the distributor 30. The conveyor 80 can be moveable in translation relative to the distributor 30.

The precursor material 20 can be cooled on the moving conveyor 80 to form a plurality of solid particles 90. The cooling can be provided by ambient cooling. Optionally the cooling can be provided by spraying the under-side of the conveyor 80 with ambient temperature water or chilled water.

Once the particles 90 (first or second) are sufficiently coherent, the particles 90 (first or second) can be transferred from the conveyor 80 to processing equipment downstream of the conveyor 80 for further processing and or packaging.

First and second particles comprising a carrier that is a water soluble polymer can be made, by way of non-limiting example, by forming particles from a melt of the composition that ultimately forms the particles. The rotoforming process can be practical to make first and second particles comprising polyethylene glycol as the carrier material. Other process for forming first and second particles can be suitable as well.

The process for forming first and second particles can comprise the step of providing a precursor material. The precursor material can be a melt of the composition that ultimately forms the first or second particles. The precursor material can be passed through apertures in a distributor that is provided. The distributor can have a plurality of apertures. A moving conveyor can be provided beneath the distributor. The precursor material can be deposited on the moving conveyor. The deposited precursor material can be cooled to form the plurality of first or second particles. The cooling can be ambient cooling or cooling in which heat is removed from the deposited precursor material to form the plurality of first or second particles.

It can be desirable to provide the precursor material at as low a temperature as possible that permits suitable first and second particles to be formed. The precursor material can be provided at a temperature less than 70° C. The precursor material can be provided at a temperature between the onset of melt of the precursor material and about 70° C.

Rotoforming can be a practical process for forming first and second particles from a melt. One suitable rotoforming device is a Sandvik ROTOFORM 3000 having a 750 mm wide 10 m long belt. The distributor of a rotoforming device is a rotating cylinder. The cylinder can have 2 mm diameter apertures set at a 10 mm pitch in the cross machine direction and 9.35 mm pitch in the machine direction. The cylinder can be set at approximately 3 mm above the belt. The belt speed and rotational speed of the cylinder can be set at about 10 m/min.

The precursor material can be provided from a mixer. The precursor material can be pumped from the mixer through a plate and frame heat exchanger set to control the outlet temperature.

The precursor material can be prepared in a batch or continuous mixer. Molten carrier material can be provided and the other constituents of the particle can be mixed with the molten carrier.

First and second particles can also be made using other approaches. For instance, granulation or press agglomeration can be appropriate. In granulation, the precursor material is compacted and homogenized by rotating mixing tools and granulated to form first and second particles. For precursor materials that are substantially free of water, a wide variety of sizes of first and second particles can be made.

In press agglomeration, the precursor material is compacted and plasticized under pressure and under the effect of shear forces, homogenized and then discharged from the press agglomeration machine via a forming/shaping process. Press agglomeration techniques include extrusion, roller compacting, pelleting, and tableting.

The precursor material can be delivered to a planetary roll extruder or twin screw extruder having co-rotating or contra-rotating screws. The barrel and the extrusion granulation head can be heated to the desired extrusion temperature. The precursor material can be compacted under pressure, plasticized, extruded in the form of strands through a multiple-bore extrusion die in the extruder head, and sized using a cutting blade. The bore diameter of the extrusion header can be selected to provide for appropriately sized first and second particles. The extruded first and second particles can be shaped using a spheronizer to provide for particles that have a spherical shape.

Optionally, the extrusion and compression steps may be carried out in a low-pressure extruder, such as a flat die pelleting press, for example as available from Amandus Kahl, Reinbek, Germany Optionally, the extrusion and compression steps may be carried out in a low pressure extruder, such as a BEXTRUDER, available from Hosokawa Alpine Aktiengesellschaft, Augsburg, Germany.

The first and second particles can be made using roller compacting. In roller compacting the precursor material is introduced between two rollers and rolled under pressure between the two rollers to form a sheet of compactate. The rollers provide a high linear pressure on the precursor material. The rollers can be heated or cooled as desired, depending on the processing characteristics of the precursor material. The sheet of compactate is broken up into small pieces by cutting. The small pieces can be further shaped, for example by using a spheronizer.

Mean Particle Size Test Method

The mean particle size of the silicone in the composition of the present invention is determined as follows.

A Horiba Laser Scattering Particle Size and Distribution Analyzer, model LA-930 (Horiba Instruments, Inc., Irvine, Calif., USA) with accompanying software (LA-930 Software, Version 3.73) is used to measure the volume-weighted diameter of silicone particles resulting from the dissolution of the test composition (i.e. composition) in water. A cuvette-type, static quartz fraction cell (10 mL capacity) is used for all measurements. The fraction cell is placed in a Horiba fraction cell holder model LY-203 (available from Horiba Instruments, Inc., Irvine, Calif., USA).

Within the instrument software, the selected graph conditions are: Density Distribution Graph is Standard; Axis Selection is Log X-Lin Y; Cumulative Distribution Graph is On; Size Class is Passing (Undersize); and Axis Type is Bar. Within the instrument software, the selected display conditions include: Form of Distribution is Standard; and Distribution Base is Volume. The Relative Refractive Index (RRI) value to be selected in the software is determined by the identity of the predominant silicone present (on a wt % basis) in the composition being tested. The RRI code selected is 106a/000i for silicone material e.g., polydimethylsiloxane or Magnasoft Plus (available from Momentive Performance Materials Inc., Waterford, N.Y., USA).

Prior to collecting measurements, the initial alignment for the instrument is set for Coarse alignment of the laser beam, and then the alignment is set for Fine alignment with filtered distilled (DI) water loaded in the background reference fraction cell. The filtered DI water background sample is then subtracted by selecting "blank" in the software. Neither the test composition sample, nor the DI water background sample is stirred during the blanking or measurement processes.

Compositions are prepared for testing by being dissolved in filtered distilled (DI) water. Initially, a dispersion with a final concentration of 0.08% (wt/wt) of the test composition in water is prepared and assessed. This initial sample dispersion is prepared by adding 0.08 g of the test composition into 100 g of the filtered DI water at 23° C.±2° C. contained within a flat-bottom glass jar of approximately 200 mL volume. The mixture is then stirred at a rate of approximately 200 rpm until dissolution of the sample is deemed to be complete, as determined when visual inspection reveals that no solid material remains, or when no further dissolution is observable over a time span of 15 minutes. This preparation results in a sample dispersion of water-immiscible particles in filtered DI water, and is the initial sample dispersion to be assessed in the instrument.

A 10 mL aliquot of the sample dispersion is used to rinse the fraction cell of the instrument, and another 10 mL aliquot of the dispersion is loaded into the fraction cell for testing. The initial sample dispersion created is tested in accordance with the instructions and instrument parameters provided above, in order to assess the Laser T % and Lamp T % values reported by the instrument for that sample concentration. These T % values are used to determine if the concentration of the test composition in the initial sample dispersion is suitable for conducting particle size measurements. The goal is to create a sample dispersion whose concentration produces values for both the Laser T % and Lamp T % parameters which fall within the range of 70% to 95%, as this indicates that the dispersion is of a suitable concentration to measure particle diameter. Frequently, the T % values will fall within the suitable range when the total final concentration of the particle-forming material(s) in the dispersion is in range of 0.01% to 0.1% (wt/wt). The T % values reported by the instrument are used to adjust the concentration of the test composition in the dispersion, such that a concentration is identified which is suitable for conducting particle size measurements. This is achieved by creating new test dispersions made at final concentrations either higher or lower than 0.08% accordingly, as needed in order to achieve T % values within the required range. Once a suitable concentration for the dispersion has been determined, new preparations at that concentration are created according to the mixing conditions specified above, for the purpose of conducting the silicone particle diameter measurements in accordance with the instructions and instrument parameters specified.

Each composition being tested is prepared and measured in at least three replicate dispersions at a suitable concentration. Each replicate sample is weighed and dissolved separately, and each replicate dispersion is measured after performing a rinse step with that preparation. Since a prepared dispersion may not be stable, all testing of samples from a dispersion is conducted within the 15 min time period immediately after the dissolution is deemed complete and the stirring has ceased. From each of the three dispersions, two 10 mL aliquots are measured. Each aliquot is measured repeatedly via three analysis runs, such that particle size data is generated three times for each aliquot. This results in six particle size analysis runs for each of the three replicate dispersions. After each particle size measurement analysis run, the instrument software displays a volume-weighted plot of Frequency (%) versus Diameter (μm) as well as the value of the mean volume-weighted particle diameter. The mean volume-weighted particle diameter values measured from all analysis runs of all replicate dispersions, are recorded and averaged, to yield the mean volume-weighted particle size diameter reported as the mean particle size of the silicone of the test composition.

Dispersion Test Method

The rate of dispersion of the carrier portion of the particles (first particles or second particles) of the consumer product composition is determined according to the following test method.

A magnetic stir bar and 200 mL of deionized water (DI water) are placed into a 250 mL capacity glass beaker located on top of a stir plate set at a stir speed of 150 rpm. The temperature of the DI water is maintained between 23° C. and 25° C. A single sample of the particles (first particles or second particles) of the composition (e.g. a single particle) is added into the beaker of stirred DI water, and a timer is started immediately at the same time. The sample (e.g. particle) is then observed visually by eye under well-lit laboratory conditions without the aid of laboratory magnification devices, to monitor and assess the appearance and size of the sample (e.g. particle) with regard to its dispersion and disintegration. This visual assessment may require the use of a flash light or other bright light source to ensure accurate observations.

The visual assessment is conducted every 10 seconds over the 60 minute time period after the addition of the sample to the water. If the dispersion of the sample results in the sample becoming visually undetectable as a discrete object(s), then the time point at which this first occurs is noted. If the dispersion of the sample results in a stable visual appearance after which no additional dispersion or disintegration is observed, then the time point at which this stable appearance first occurs is noted. A value of 60 min is assigned if the sample is still visible at the 60 minutes time point and it appeared to still be undergoing dispersion or disintegration immediately prior to the 60 min time point. For each material being tested, the assessment is repeated ten times to result in ten replicate measurements. The time values noted for the ten replicates are averaged, and this average value is reported as the Dispersion Time value determined for that test material.

Onset of Melt Test Method

Onset of melt is determined using the onset of melt test method as follows. Differential Scanning calorimetry (DSC) is used to quantify the temperature at which the onset of melt occurs for the peak melt transition of any given composition of particles to be tested. The melt temperature measurements are made using a high quality DSC instrument with accompanying software and nitrogen purge capability, such as TA Instruments' model Discovery DSC (TA Instruments Inc./Waters Corporation, New Castle, Del., U.S.A.). A calibration check is conducted using an Indium standard sample. The DSC instrument is considered suitable to conduct the test if the onset of melt temperature measured for the Indium standard sample is within the range of 156.3-157.3° C.

A plurality of particles of the test composition are examined in order to identify individual particles which comprise a first class of particle versus those which comprise a second class of particle, and those that comprise any additional number of classes which may be present. The process of examining a plurality of particles to achieve such class identifications may include many approaches, including the examination and comparison of individual particles by visual inspection, examination and comparison of individual particles based on chemical makeup, and by chemical testing to determine the presence or absence of silicone or perfumes in the interior of individual particles. Test compositions are to be tested on a per class basis (i.e., by physically separating individual particles according to their class, thus creating internally uniform samples wherein each sample comprises a single class of particle). These samples are used to test particles from each class separately from particles of other classes. The results measured for each class of particle are reported separately (i.e. on a per class basis).

For each class of particle present in the test composition, a uniform test sample is prepared by obtaining at least 5 g of particles of that class, which are then pulverised via milling into powder form using an analytical milling device, such as the IKA basic analytical mill model A11 B S1 (IKA-Werke GmbH & Co. KG, Staufen im Breisgau, Germany) The milled sample is subsequently sieved through a clean stainless steel sieve with sieve mesh size openings of nominally 1 mm in diameter (e.g. number 18 mesh size). For each sample to be tested, at least two replicate samples are independently milled and measured. A sample of the milled material weighing approximately 5 mg is placed into the bottom of a hermetic aluminium DSC sample pan, and the sample is spread out to cover the base of the pan. A hermetic aluminium lid is placed on the sample pan, and the lid is sealed with a sample encapsulating press to prevent evaporation or weight loss during the measurement process. The DSC measurements are conducted relative to a reference standard. An empty aluminium DSC sample pan used as the reference standard, in order to measure the delta in heat adsorption of the sample-containing pan versus the empty reference pan.

The DSC instrument is set up to analyze samples using the following cycle configuration selections: Sample Purge Gas is nitrogen set at 50 mL/min; Sampling Interval is set at 0.1 s/point; Equilibrate is set at −20.00° C.; Isothermal Hold is set at 1 min. Data is collected during a single heating cycle using the settings: Ramp is set at 10.00° C./min to 90.00° C.; and Isothermal Hold is set at 90.00° C. for 1 min. A sealed sample pan containing a replicate test sample is carefully loaded into the instrument, as is an empty reference pan. The DSC analysis cycle specified above is conducted and the output data is assessed. The data acquired during the DSC heating cycle is typically plotted with Temperature on the X-axis (in ° C.) and Heat Flow normalized to sample weight (in W/g) on the Y-axis, such that melting points appear as downward (endothermic) peaks since they absorb energy.

A melt transition onset temperature is the temperature at which a deflection is first observed from the baseline previously established for the melt temperature of interest. The Peak Melt temperature is the specific temperature that requires the largest observed differential energy to transition the sample from a solid phase to a melt phase, during the specified DSC heating cycle. For the purpose of this invention, the Onset of Melt temperature is defined as the melt transition onset temperature for the Peak Melt temperature. Additional general information on the DSC technique may be found in the industry standard method ASTM D3418-03—Transition Temperatures of Polymers by DSC.

Using the DSC instrument software, two points are manually defined as the "Start and Stop Integration" baseline limits. The two points selected are on flat regions of the baseline to the left and right sides, respectively, of the melt transition peak detected. This defined area is then used to determine the peak temperature (T) which can be used to report the Peak Melt Temperature. The Onset of Melt temperature for the Peak Melt temperature is then identified by the instrument software.

For each class of particle in a test composition, the Onset of Melt temperature reported is the average result (in ° C.) from the replicate samples of that class of particle.

Examples/Combinations

The following are nonlimiting examples of compositions that can be formulated to deliver a scent and fabric softness benefit through the wash. In the following examples, the amounts of the formulation components within the particles are percent by weight with respect to the particular particle (first particle or second particle). The weight fraction of the composition that combines first particles and second particles is percent by weight of the composition.

| | Example A | | Example B | | Example C | |
|---|---|---|---|---|---|---|
| | First Particles | Second Particles | First Particles | Second Particles | First Particles | Second Particles |
| PLURIOL 9000[A] | 87.3 | 68 | 90 | 75 | 90 | 70 |
| Silicone[B] | — | 32 | — | 25 | — | 30 |
| Encapsulated Perfume[C] | 1.1 | — | 0.8 | — | 2 | — |
| Unencapsulated Perfume | 7.5 | — | 4.8 | — | 6.0 | — |
| Dye[D] | 0.012 | — | 0.012 | — | 0.012 | — |
| Dipropylene Glycol | 1.1 | — | 1.1 | — | 1.1 | — |
| Minors | Remainder for the above to total 100% | — | Remainder for the above to total 100% | — | Remainder for the above to total 100% | — |
| Weight Fraction of Composition | 65 | 35 | 50 | 50 | 35 | 65 |

[A]Available from BASF
[B]Dow Corning(R) XX-8766 Amino Polymer
[C]Encapsulated perfume available from Encapsys
[D]LIQUITINT BLUE BL available from Millikin Chemical Further examples and combinations can be as follows:

A. A composition comprising:
(i) a plurality of first particles comprising:
about 30% to about 98% by weight of said first particles a water soluble first carrier, wherein said first particles have a first particles onset of melt from about 25° C. to about 120° C.; and
perfume carried by said first carrier; and
(ii) a plurality of second particles comprising:
about 30% to about 98% by weight of said second particles a water soluble second carrier, wherein said second particles have a second particles onset of melt from about 25° C. to about 120° C.; and
silicone carried by said second carrier;
wherein said first particles and said second particles are in a package.

B. The composition according to Paragraph A, wherein said first carrier and said second carrier comprise a water soluble polymer.

C. The composition according to Paragraph A or B, wherein said first particles onset of melt and said second particles onset of melt differ by less than 40° C.

D. The composition according to any one of Paragraphs A to C, wherein said first carrier and said second carrier comprise a monomer present in both said first carrier and said second carrier.

E. The composition according to any one of Paragraphs A to D, wherein said first carrier and second carrier are selected from the group consisting of polyvinyl alcohol, modified polyvinyl alcohol, polyvinyl pyrrolidone, polyvinyl alcohol/polyvinyl pyrrolidone, polyvinyl alcohol/polyvinyl amine, partially hydrolyzed polyvinyl acetate, polyalkylene oxide, polyethylene glycol, acrylamide, acrylic acid, cellulose, alkyl cellulosics, methyl cellulose, ethyl cellulose, propyl cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides, starch, modified starch, gelatin, alginates, xyloglucans, hemicellulosic polysaccharides, xylan, glucuronoxylan, arabinoxylan, mannan, glucomannan, galactoglucomannan, natural gums, pectin, xanthan, carrageenan, locus bean, arabic, tragacanth, polyacrylates, sulfonated polyacrylates, water-soluble acrylate copolymers, alkylhydroxy cellulosics, methylcellulose, carboxymethylcellulose sodium, modified carboxy-methylcellulose, dextrin, ethylcellulose, propylcellulose, hydroxyethyl cellulose, hydroxypropyl methylcellulose, maltodextrin, polymethacrylates, polyvinyl alcohol copolymers, hydroxypropyl methyl cellulose, and mixtures thereof.

F. The composition according to any one of Paragraphs A to E, wherein said perfume is dispersed in said first carrier.

G. The composition according to any one of Paragraphs A to F, wherein said silicone is dispersed in said second carrier.

H. The composition according to any one of Paragraphs A to G, where said perfume is encapsulated within a shell wall.

I. The composition according to any one of Paragraphs A to H, wherein said silicone is present in said second particles in droplets.

J. The composition according to any one of Paragraphs A to I, wherein said silicone is present in said second particles in droplets having a mean particle size of from about 2 μm to about 2000 μm.

K. The composition according to any one of Paragraphs A to J, wherein said composition comprises from about 10% to about 90% by weight said first particles and from about 10% to about 90% by weight said second particles.

L. The composition according to any one of Paragraphs A to K, wherein said first carrier and said second carrier are different materials.

M. The composition according to any one of Paragraphs A to K, where said first carrier and said second carrier are the same material.

N. The composition according to any one of Paragraphs A to M, where said first particles and said second particles mixed together have a coefficient of uniformity of less than 2.

O. The composition according to any one of Paragraphs A to N, wherein said first particles have a first particles D50 and said second particles have a second particles D50, wherein said second particles D50 is within about 20% of said first particles D50.

P. The composition according to any one of Paragraphs A to O, wherein said first particles comprise about 0.1% to about 20% by weight of said first particles of perfume.

Q. The composition according to any one of Paragraphs A to P, wherein said first particles comprise more perfume by weight percent than said second particles.

R. The composition according to any one of Paragraphs A to Q, wherein said composition comprises less than 5% by weight surfactant.

S. The composition according to any one of Paragraphs A to R, wherein said first particles comprise less than 3% by weight of said first particles silicone.

T. The composition according to any one of Paragraphs A to S, wherein said second particles comprise from about 3% to about 50% by weight of said second particles silicone.

U. The composition according to any one of Paragraphs A to T, wherein said first particles are together in a single chamber of said package.

V. The composition according to any one of Paragraphs A to U, wherein said composition comprises about 65% by weight said first particles and about 35% by weight said second particles.

W. A process for laundering articles of fabric with the composition of any one of Paragraphs A to V comprising the steps of:

dispensing into a washing machine said composition according to Paragraph A into a washing machine; a first composition comprising first particles and second particles, wherein said first particles comprise a water soluble first carrier and perfume and said second particles comprise a water soluble second carrier and silicone;

dispensing into said washing machine a detergent composition comprising a surfactant, wherein said composition and said detergent composition are from different packages; placing one or more articles of fabric into said washing machine; and washing said fabric with said composition and said detergent composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A composition comprising:

(i) a plurality of first particles comprising:

about 30% to about 98% by weight of said first particles a water soluble first carrier, wherein said first particles have a first particles onset of melt from about 25° C. to about 120° C.; and perfume carried by said first carrier; and (ii) a plurality of second particles comprising:

about 30% to about 98% by weight of said second particles a water soluble second carrier, wherein said second particles have a second particles onset of melt from about 25° C. to about 120° C.; and 15% to about 60% by weight of said second particles a silicone carried by said second carrier;

wherein said first particles and said second particles are in a package; wherein said composition comprises from about 10% to about 90% by weight said first particles and from about 10% to about 90% by weight said second particles; and wherein said first particles differ from said second particles.

2. The composition according to claim 1, wherein said first carrier and said second carrier comprise a water soluble polymer.

3. The composition according to claim 2, wherein said first particles onset of melt and said second particles onset of melt differ by less than 40° C.

4. The composition according to claim 3, wherein said perfume is dispersed in said first carrier.

5. The composition according to claim 4, wherein said silicone is dispersed in said second carrier.

6. The composition according to claim 5, wherein said first particles comprise about 0.1% to about 20% by weight of said first particles of perfume.

7. The composition according to claim 6, wherein said silicone is dispersed within said second particles in droplets.

8. The composition according to claim 7, wherein said droplets have a mean particle size of from about 2 μm to about 2000 μm.

9. The composition according to claim 8, where said first particles and said second particles mixed together have a coefficient of uniformity of less than 2.

10. The composition according to claim 9, wherein said first particles have a first particles D50 and said second particles have a second particles D50, wherein said second particles D50 is within about 20% of said first particles D50.

11. The composition according to claim 10, wherein said composition comprises less than 5% by weight surfactant.

12. The composition according to claim 1, wherein said first particles have a first particles D50 and said second particles have a second particles D50, wherein said second particles D50 is within about 20% of said first particles D50.

13. The composition according to claim 1, wherein said composition comprises about 65% by weight said first particles and about 35% by weight said second particles.

14. The composition according to claim 1, wherein said first carrier and said second carrier comprise a monomer present in both said first carrier and said second carrier.

15. The composition according to claim 1, wherein said first carrier and second carrier are selected from the group consisting of polyvinyl alcohol, modified polyvinyl alcohol, polyvinyl pyrrolidone, polyvinyl alcohol/polyvinyl pyrrolidone, polyvinyl alcohol/polyvinyl amine, partially hydrolyzed polyvinyl acetate, polyalkylene oxide, polyethylene glycol, acrylamide, acrylic acid, cellulose, alkyl cellulosics, methyl cellulose, ethyl cellulose, propyl cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides, starch, modified starch, gelatin, alginates, xyloglucans, hemicellulosic polysaccharides, xylan, glucuronoxylan, arabinoxylan, mannan, glucomannan, galactoglucomannan, natural gums, pectin, xanthan, carrageenan, locus bean, arabic, tragacanth, polyacrylates, sulfonated polyacrylates, water-soluble acrylate copolymers, alkylhydroxy cellulosics, methylcellulose, carboxymethylcellulose sodium, modified carboxy-methylcellulose, dextrin, ethylcellulose, propylcellulose, hydroxyethyl cellulose, hydroxypropyl methylcellulose, maltodextrin, polymethacrylates, polyvinyl alcohol copolymers, hydroxypropyl methyl cellulose, and mixtures thereof.

16. The composition according to claim 1, where said perfume is encapsulated within a shell wall.

17. The composition according to claim 1, wherein said first carrier and said second carrier are different materials.

18. The composition according to claim 1, where said first particles and said second particles are together in a single chamber of said package.

19. A process for laundering articles of fabric with the composition of claim 1 comprising the steps of:

dispensing said composition according to claim 1 into a washing machine dispensing into said washing machine a detergent composition comprising a surfactant, wherein said composition and said detergent composition are from different packages;

placing one or more articles of fabric into said washing machine; and washing said fabric with said composition and said detergent composition.

* * * * *